US005535795A

United States Patent [19]

Bunn

[11] Patent Number: 5,535,795

[45] Date of Patent: Jul. 16, 1996

[54] LOG SPLITTING ATTACHMENT FOR A HAND JACK

[76] Inventor: Hugh F. Bunn, Box 236, Snow Lake, Canada

[21] Appl. No.: 509,580

[22] Filed: Jul. 31, 1995

[51] Int. Cl.[6] ..... B27L 7/00

[52] U.S. Cl. ..... 144/195.4; 144/195.8

[58] Field of Search ..... 144/193 R, 193 C, 144/193 H, 366; 254/104, 105, 108, 112

[56] References Cited

U.S. PATENT DOCUMENTS

| | | | |
|---|---|---|---|
| 881,538 | 3/1908 | Bienk | 144/193 H |
| 1,191,176 | 7/1916 | Harber | 144/193 C |
| 4,061,168 | 12/1977 | Fariss, Jr. | 144/193 R |
| 4,244,407 | 1/1981 | McMullin | 144/193 H |
| 4,354,537 | 10/1982 | Balkus | 144/193 C |

FOREIGN PATENT DOCUMENTS

| | | | |
|---|---|---|---|
| 2513561 | 4/1983 | France | 144/193 H |

*Primary Examiner*—W. Donald Bray
*Attorney, Agent, or Firm*—Adrian D. Battison; Murray E. Thrift

[57] ABSTRACT

The present invention provides a log splitting attachment for use with a hand jack particularly of the type for use splitting precut logs. The log splitting attachment is used with a manually operated jack, is easily transported from place to place, and is simple and inexpensive enough for non-commercial use. The log splitting attachment comprises a jack mount for holding a hand jack, a log support for holding a log to be split, a frame for supporting the device on the ground or other supporting surface and connecting the jack mount to the log support, and a removable and reengageable wedge connected to the jack for engaging the top of a log and splitting the log.

17 Claims, 4 Drawing Sheets

LOG SPLITTING ATTACHMENT FOR A HAND JACK

FIELD OF THE INVENTION

The present invention provides a log splitting attachment for use with a hand jack particularly of the type for use splitting precut logs.

BACKGROUND

Splitting cut logs into sections of a size which will burn well and which are appropriate for use in fire places, stoves, and the like requires a considerable amount of effort and therefore has resulted in a number of labour saving devices being invented.

Various wedge type devices for manually driving into logs have been developed for splitting logs. These devices are usually driven into a log with a hammer, mallet, or similar tool, and are usually driven either into one of the ends, or into the side of the log. This requires less precision than splitting the log with an ax and therefore requires less effort due to a reduction in the number of blows required to split the log. Using a manually driven wedge type log splitter however still requires a considerable amount of effort to employ and therefor these devices present a poor solution if a large number of logs need to be split.

Powered log splitting devices are currently widely available and are effective tools for splitting logs. These devices usually cut or split the logs using a wedge or blade attached to the end of a hydraulically driven member powered by an electric motor or internal combustion engine. Although effective these log splitters are too expensive, and too difficult to transport to be widely used by individuals other than those involved in the commercial production of fire wood.

A log splitting device is needed which can be operated manually, which is easily transported from place to place, and which is simple and inexpensive enough for non-commercial use.

SUMMARY

According to one aspect of the present invention there is provided a hand jack and log splitting attachment comprising: a hand jack having a jack body, a jack actuating means, and a jack member arranged such that manually actuating the jack actuating means causes the jack member to move away from the jack body; a log splitting attachment including: a jack mounting means for holding the jack body; a log support means for holding a log to be split, said log support means being spaced from the jack mounting means and aligned with the jack member; a frame connecting the jack mounting means to the log support means; and a wedge arranged to engage an end of the log such that manually actuating the jack actuating means causes the wedge to engage the log thereby splitting said log.

The jack mounting means may be modified to accommodate any manually operated hand jack.

According to a second aspect of the present invention there is provided a hand jack and log splitting attachment comprising: a hand jack having a jack body, a jack actuating means, and a jack member extending through the jack body, arranged such that manually actuating the jack actuating means causes the jack member to move downwards relative to the jack body; a log splitting attachment including: jack mounting means for holding the jack body; a log support means for holding a log to be split, said log support means being spaced downwards from the jack mounting means and aligned with the jack member; a frame including a frame base for supporting the frame on a supporting surface, and an upright support means being fixed at one end to the frame base and extending upwards therefrom and being fixed at an end opposite to the jack mounting means; and a wedge being connected to an end of the jack member opposite the jack body for engaging a top of the log, such that manually actuating the jack actuating means causes the wedge to move downwards away from the jack body engaging the top of the log thereby splitting said log.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
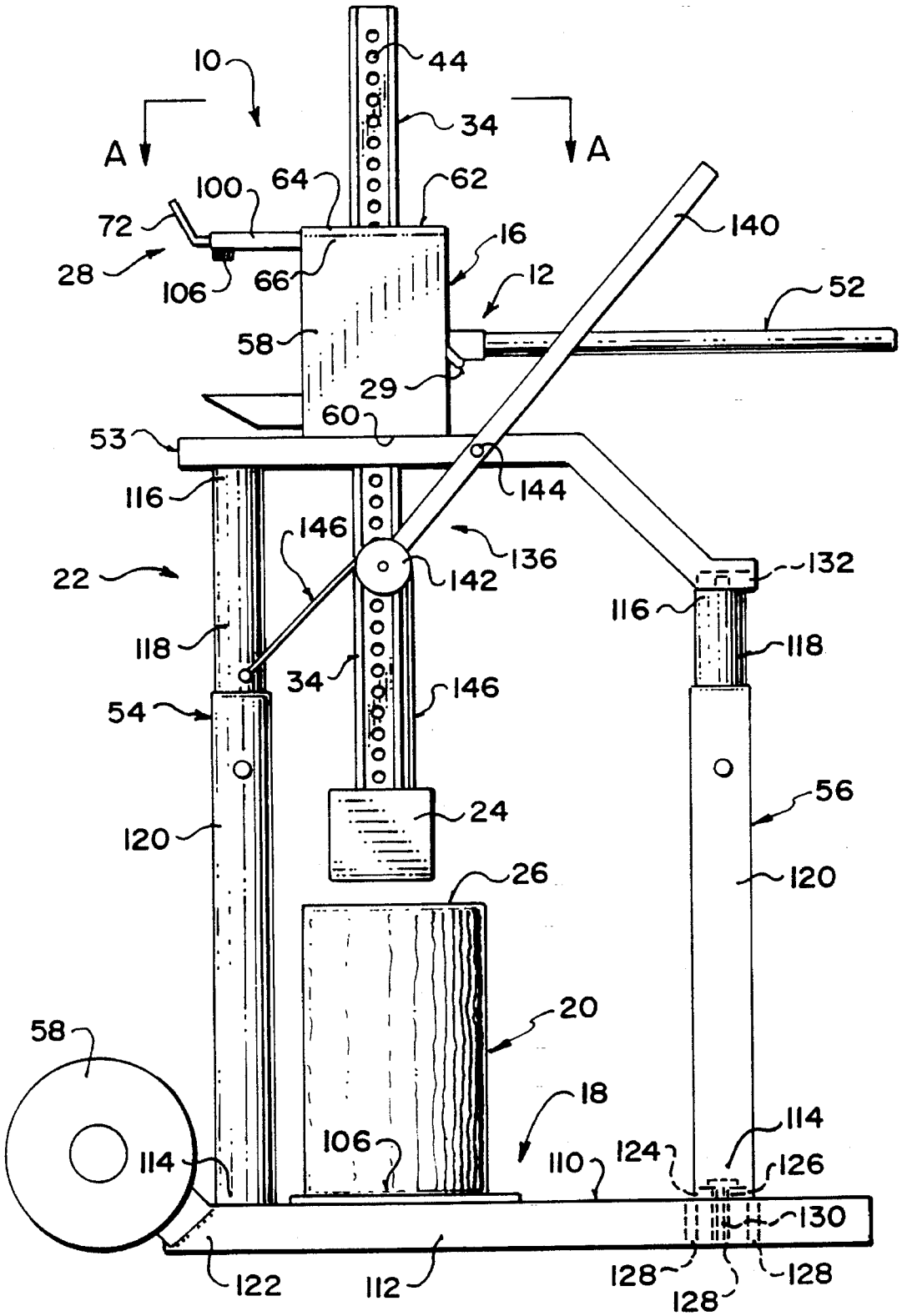
FIG. 1 is a side view of the log splitting attachment and the jack.
Figure 2:
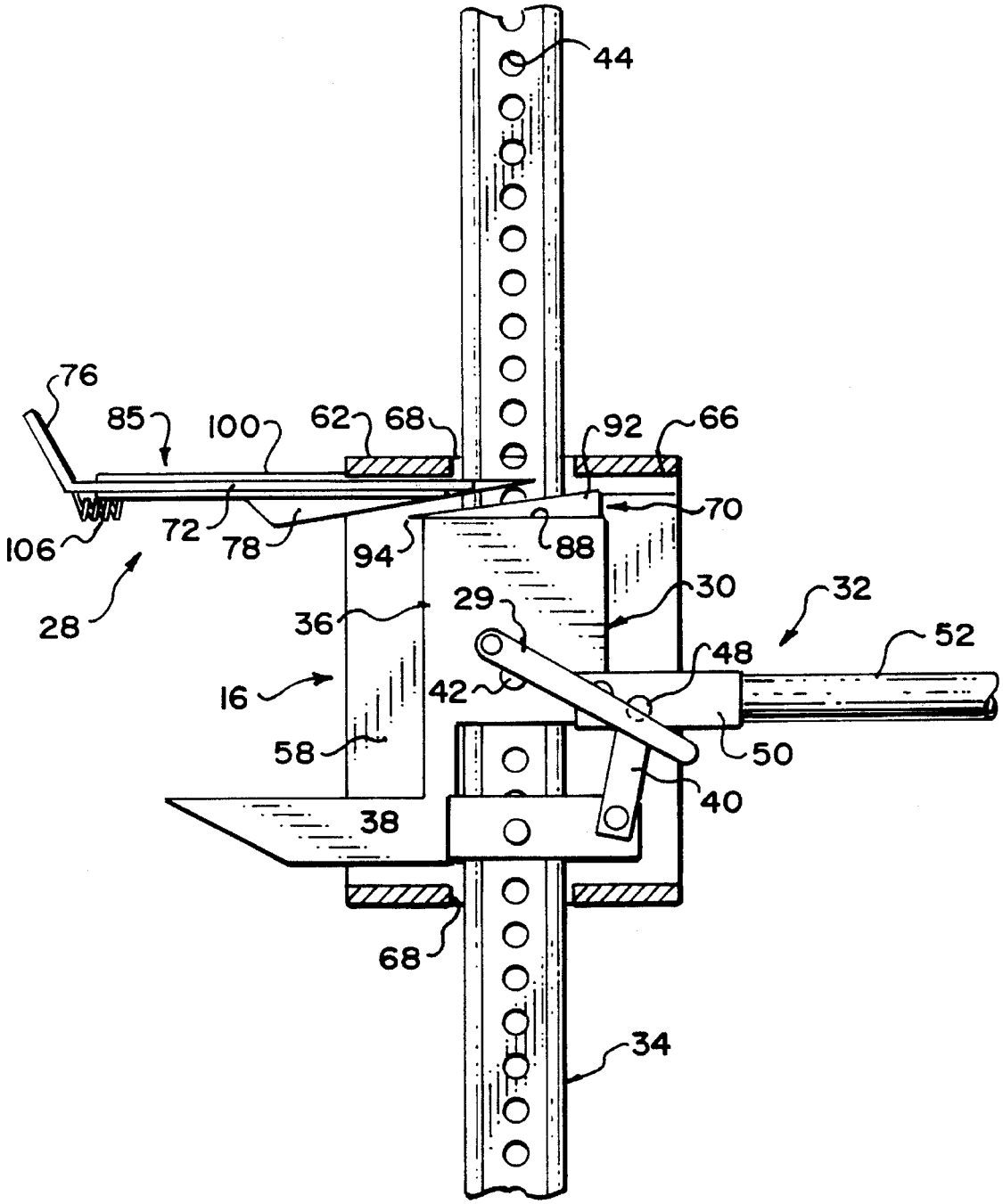
FIG. 2 is a cross sectional view of the log splitting attachment and the jack through A—A.

Referring to FIGS. 1 and 2 the hand jack and log splitting attachment is shown generally at 10. The log splitting attachment is used with a manually operated jack 12 and comprises a jack mount 16 for holding the hand jack 12, a log support 18 for the holding the log 20, a frame 22 for supporting the device on the ground or other supporting surface and connecting the jack mount 16 to the log support 18, a wedge 24 connected to the jack 12 for engaging the top 26 of the log 20 and splitting the log 20, and spacer means 28 for repositioning the jack within the jack mount. The jack 12 includes a switching lever 29 for switching the jack 12 from operating in a jacking mode when the switching lever 29 is in the up position into a lowering mode when the switching lever 29 is in the down position. The hand jack 12 described in the following is a step type jack, however any appropriate manually operated jack may be used with some modification to the jack mount 16.

The hand jack 12 comprises a jack body 30, a jack actuating means 32, and a jack member 34. The jack member 34 extends through the jack body 30, such that manually actuating the jack actuating means 32 causes the jack member 34 to move downwards relative to the jack body 30.

The jack body 30 includes a first portion 36 and a second portion 38 lying adjacent to one another and being arranged around the jack member 34 for alternately engaging the jack member 34. The first and second portions 36 and 38 are connected to one another and to the jack actuating means 32 by a linkage 40 and have pins 42 which are moved to engage with, or disengage from, a plurality of holes 44 in the jack member 34 as the jack actuating means 32 is moved through a complete stroke. The plurality of holes 44 in the jack member 34 extend along its length and are spaced ¾ inches apart causing the first and second portions 36 and 38 to take ¾ inch steps as they are moved. Moving the jack actuating means 32 through a complete stroke involves moving the jack actuating means 32 downwards in a jacking stroke and then upwards in a return stroke. When the jack 12 is in the jack mount 16 and the switching lever 29 is in the up position moving the jack actuating means 32 through a complete stroke results in downwards movement of the jack member 34.

The jack actuating means 32 include a lever member having a fulcrum 48, a lever portion 50, and a handle 52. The lever portion 50 is pivotally connected to the linkage 40 such that as the handle 52 is moved the ratio of the distance from the fulcrum 48 to an end of the lever portion 50 to the distance from the fulcrum 48 to the end of the handle 52 varies. This results in the output force to input force ratio of the jack 12 varying as the jack actuating means 32 is moved through each of the jacking and return strokes. The output force to input force ratio increases through a first ratio range to about 28 to 1 when the handle 52 is moved between the top of the stroke to the horizontal, and through a second ratio range to about 112 to 1 when the handle 52 is moved between the horizontal to the bottom of the stroke.

The jack mount 16 includes an elongate member 53 which is about 5 inches in width which is fixed to the upright support means 54 and 56 and lies in a horizontal plane forming a bottom wall. A pair of parallel side plates 58 are each fixed along a bottom edge 60 to a respective side of the elongate member 53 and extend upwards therefrom. A top plate 62 is fixed along each of its sides 64 to a respective top edge 66 of the pair of parallel side plates 58, and is spaced upwards from the elongate member 53 a distance equal to the height of the jack body 30 plus about 1 inch. A pair of vertically aligned openings 68 one in each of the elongate member 53 and the top plate 62 receive the jack member 34 allowing it to move up and down as the jack 12 is operated. The jack body 30 can be removably received within the jack mount 16 positioned on the elongate member 53 between the side plates 58 and beneath the top plate 62.

Figure 3:
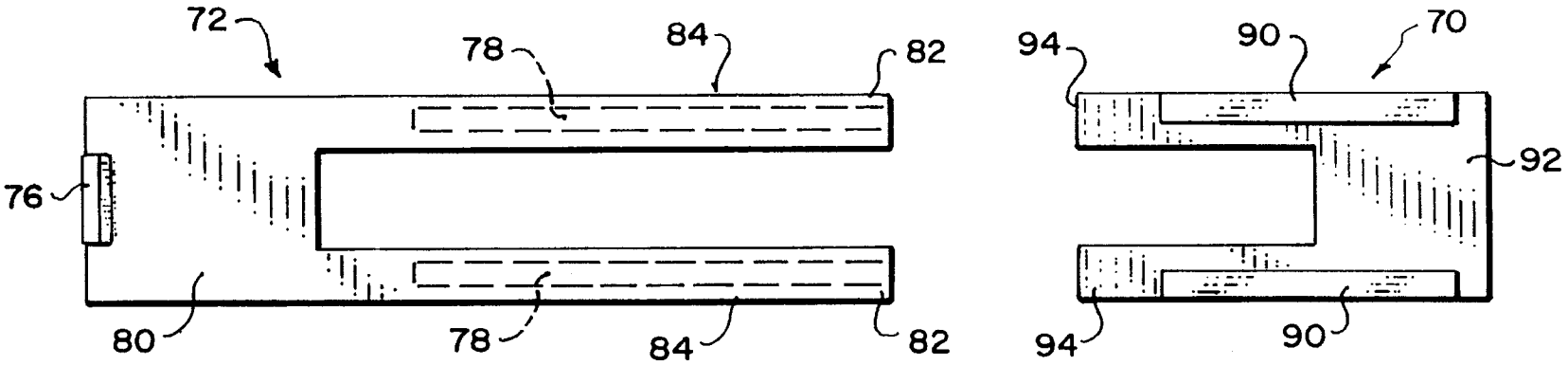
FIG. 3 is a top view of the insertable spacer and the head pressure spacer.
Figure 4:
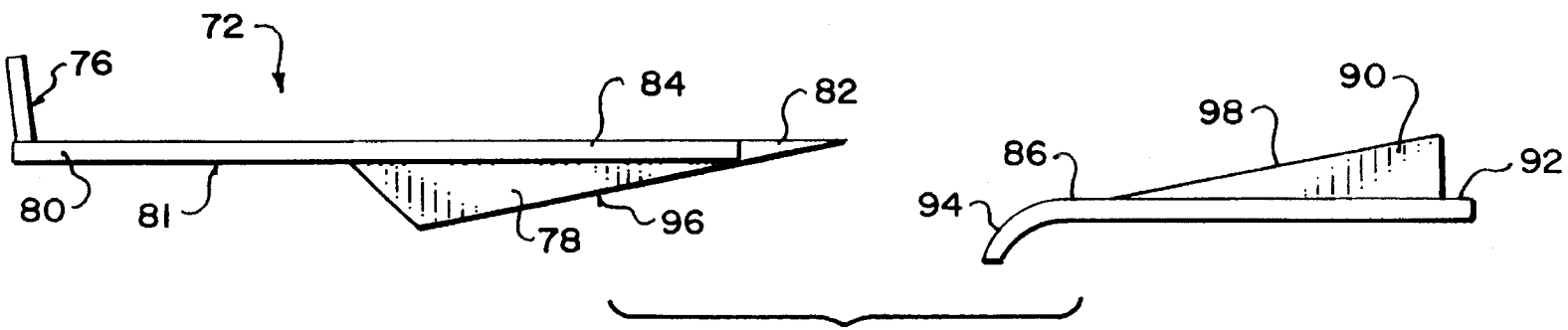
FIG. 4 is a side view of the insertable spacer and the head pressure spacer.

Referring to FIG. 3 and 4 the spacer means 28 includes a head pressure spacer 70 arranged on a top surface 88 of the first portion 36 of the jack body 30 between the jack body 30 and the top plate 62 of the jack mount 16, and an insertable spacer 72 being slidably connected by slider 74 to an under side of the top plate 62 of the jack mount 16. The spacer means 28 reposition the hand jack 12 within the jack mount 16 in steps such that the hand jack 12 operates in the second ratio range.

The insertable spacer 72 comprises an elongate substantially U-shaped plate member for engaging around the jack member 34. A handle 76 is positioned at the base 80 of the U lying opposite the jack mount 16 and a wedge portion 78 extends downwards and along a bottom 81 of each arm of the U-shaped plate. The wedge portion 78 tapers from a maximum width of about ½ to ⅝ inches adjacent the base 80 of the U-shaped plate to a minimum width at the end 82 of each arm. The ends 82 of the arms lie adjacent the jack mount 16 for insertion therein. A flange 84 extends laterally outwards from the outer side edge of each arm of the insertable member for engaging the slider 74 for positioning the insertable spacer within the jack mount.

The head pressure spacer 70 comprises a substantially U-shaped plate member for engaging around the jack member 34. The head pressure spacer 70 is positioned on a top surface 88 of the first portion 36 of the jack body 30 and has a wedge portion 90 extending upwards along a top side of each arm of the U shaped plate. The wedge portion 90 tapers from a maximum width of about ½ inch adjacent the base 92 of the U-shape plate to a minimum width adjacent the end 94 of each arm. The head pressure spacer 70 is positioned with the ends 94 of the arms lying adjacent the insertable spacer 72 and the base 92 of the U-shaped plate lying opposite the insertable spacer 72.

The insertable spacer 72 is slidably movable between a disengaged position to a fully engaged position. When in a disengaged position the insertable spacer 72 lies outside the jack mount 16 and does not engage the head pressure spacer 70, and when in the fully engaged position the insertable spacer 72 lies fully inserted within the jack mount 16. The insertable spacer 72 can also be positioned in a plurality of incremental positions between the disengaged and fully engaged positions. As the insertable spacer 72 is inserted a lower surface 96 of the wedge 78 contacts with the top surface 98 of the wedge of the head pressure spacer 70 thereby spacing the hand jack body 30 downwards from the top plate 62 of the jack mount 16.

Figure 5:
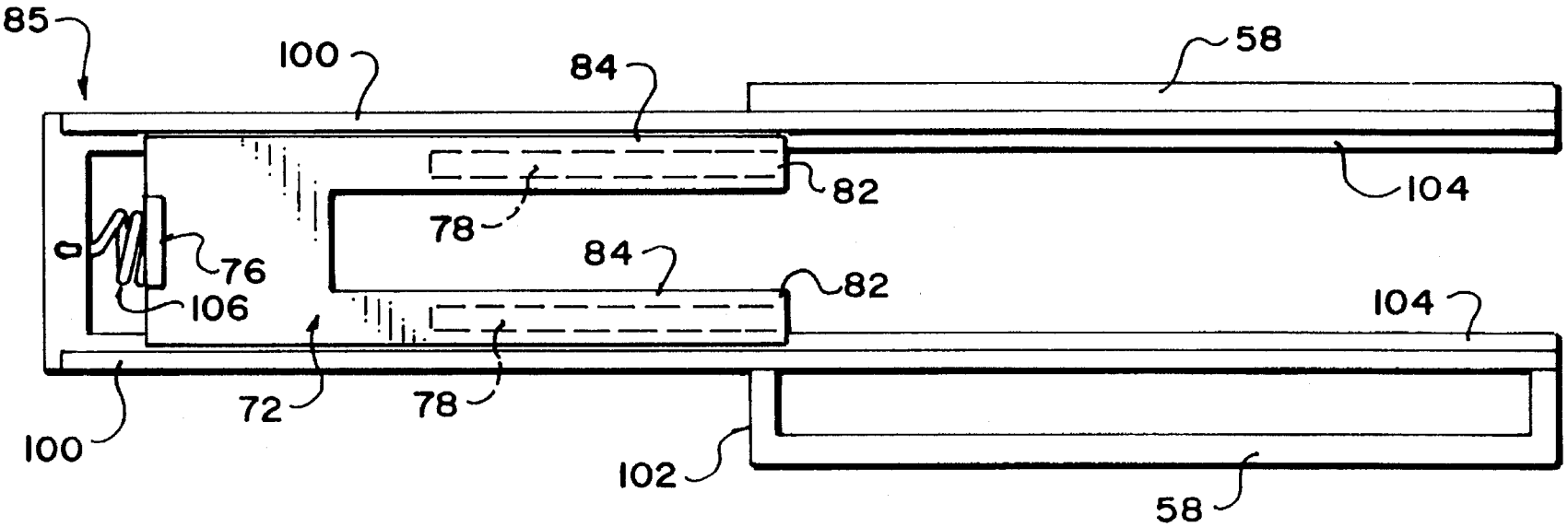
FIG. 5 is a top view of the insertable spacer and slider.

Referring to FIG. 5 the slider 85 comprise a pair of rails 100 each extending along the top edge 66 of a respective one of the parallel side plates 58 and outwards from a side 102 of the jack mount 16. The rails 100 are spaced apart from one another and have a flange 104 that extends inwards from an inner side of each rail for engaging respective flanges 84 on the insertable spacer 72. A return spring 106 is arranged to bias the insertable spacer 72 to the disengaged position when the first portion 36 of the jack body 30 engages the jack member 34.

The log support 18 comprises a plate 106 lying in a substantially horizontal plane spaced downwards from the jack mount 16 being aligned with the jack member 34 and being fixed to a top surface 110 of the frame base 112.

The frame 22 comprises a frame base 112, an upright support means 54 and 56, and wheels 58. The frame base 112 is an elongate piece of channel iron approximately 6 inches by 24 inches arranged for supporting the frame 22 on the ground or other supporting surface. The frame base 112 includes reinforced sides for additional strength.

The upright support means comprise a first and second upright support 54 and 56. The first and second upright supports 54 and 56 are fixed at a bottom end 114 to the frame base 112 and extend upwards therefrom to an upper end 116. The first and second upright supports 54 and 56 are fixed at their upper ends 116 to a respective end of the elongate member 53 of the jack mount 16. Each upright support 54 and 56 is made up of two telescoping pipes 118 and 120, being 1.5 inches and 1.75 inches in diameter respectively. The telescoping pipes 118 and 120 make it possible to adjust the first and second upright supports 54 and 56 for splitting logs of various heights.

The first upright support 54 is fixed at its bottom end 114 to the frame base 112 near one end 122 of the frame base 112. The second upright support 56 is arranged at an end opposite and is laterally adjustable having a flat plate 124 with a threaded hole 126 therethrough welded to its bottom end. A plurality of holes 128 spaced about 3 inches apart extend longitudinally along the frame base 112 from the end 122 of the frame base 112 adjacent the second upright support 56 inwards towards the first upright support 54. The second upright support 56 is adjusted laterally by aligning the threaded hole 126 with one of the plurality of holes 128 and is held in place by a bolt 130 extending through the one of the plurality of holes 128 and engaging the threads in the plate 124. A slidable connection means 132 is located at an upper end 116 of the second upright support 56 for fixing to the jack mounting means 16.

Wheels 58 are rotatably mounted to the frame base 112 at the end 122 adjacent the first upright support 54 and are arranged such that the wheels 58 engage the supporting surface when the frame 22 is tilted over the wheels 58 for transportation.

The wedge 24 is connected to the bottom end of the jack member 34 for engaging the top surface 26 of the log 20 and splitting the log. The wedge 24 is bolted to the bottom most one of the plurality of holes 44 in the jack member 34 and moves with the jack member 34.

A wedge lifting means 136 is fixed to the frame 22 and to the wedge 24 for raising the jack member 34 and the wedge 24 to a height such that a log 20 can be positioned beneath the wedge 24 for splitting. The wedge lifting means 136 includes a lever 140 having a guide means 142 fixed at one end, a pivot connection 144 connecting the lever 140 to the frame 22 at a point spaced from one end of the lever, and an elongate flexible connection means 146 fixed to a top surface of the wedge 24 at one end and to the frame 22 at an end opposite extending over the guide means 142 between said ends.

Pivoting the lever 140 in a downwards direction moves the guide means 142 upwards drawing the elongate flexible connection means 146 and the wedge 24 upwards, and pivoting the lever 140 in an upwards direction moves the guide means 142 downwards lowering the elongate flexible connection means 146 and the wedge 24 downwards.

To use the device a cut log section 20 is placed on the log support plate 18 and the frame 22 is adjusted so that the wedge 24 is positioned above the log 20 for splitting. The handle 52 of the jack actuating means 32 is raised to the top of the return stroke with the switching lever 29 in the up position and the jack 12 operating in jacking mode. In this position the second portion 38 of the jack 12 is in contact with the elongate member 53 at the bottom of the jack mount 16 and is engaged with the jack member 34. As the handle 52 is moved downwards in a first jacking stroke the first portion 36 of the jack body 30 disengages the jack member 34 and moves upwards a full step of about ¾ of an inch to within about ½ inch of the top plate 62 of the jack mount 16, and engages the jacking member 34. During this stroke there is no movement of the jack member 34 and therefore no movement of the wedge 24.

When the bottom of the jacking stroke is reached the handle 52 is moved upwards through a return stroke back to its starting position at the top of the return stroke. This causes the second portion 38 of the jack 12 to move along the jack member 34 to a position adjacent the first portion 36 and engage the jack member 34.

As the handle 52 is moved downwards in a second jacking stroke the first portion 36 of the jack body 30 disengages from the jack member 34 and moves upwards about ½ inch until the head pressure spacer 70 on the top surface of the first portion 36 contacts the top plate 62 of the jack mount 16. When this occurs the first potion 36 can no longer move upwards and the second portion 38 and jack member 34 are forced downwards driving the wedge 24 into the log 20.

When the handle 52 reaches the bottom of the jacking stroke the first portion 36 engages the jack member 34. The handle 52 is then moved through a return stroke during which the first portion 36 and jack member 34 remain stationary while the second portion 38 disengages the jack member 34 and moves upwards along the jack member 34 to a position adjacent the first portion 36. When the handle 52 reaches the top of the return stroke the second portion 38 reengages the jack member 34. This is repeated until it becomes difficult to drive the wedge 24 into the log 20.

When resistance to the wedge 24 becomes high the spacer means 28 can be used to reposition the hand jack 12 within the jack mount 16 causing it to operate in the second ratio range. As the handle 52 passes through the jacking stroke from the upper portion of the stroke to the lower portion of the stroke the output force to input force ratio passes from the first ratio range to the second ratio range by moving the fulcrum pin 48 closer to the jack member 34. The second ration range therefore can be maintained by keeping the handle 52 in the lower portion of the jacking stroke while jacking.

When the handle 52 is at the bottom of a regular jacking stroke the head pressure spacer 70 is in contact with the top plate 62. For the jack to continuously work in the second ratio range the head pressure spacer 70 and first portion 36 have to be lowered. This is done in the following manner. The switching lever 29 is moved into the down position when the handle 52 is at the bottom of a jacking stroke, thereby switching the jack 12 into lowering mode. This causes the second portion 38 of the jack body 30 to remain engaged with the jack member 34, and instead of the second portion 38 moving upwards towards the first portion 36 as the handle 52 is raised, the first portion 36 moves downwards to the second portion 38 leaving a space between the head pressure spacer 70 and the top plate 62.

The jack is now returned to the jacking mode by switching lever 29 is moved into the up position and the handle 52 is raised through a partial return stroke making sure to remain in the lower portion of the stroke and therefore in the second ratio range. This creates a space between the head pressure spacer 70 and the top plate 62. The insertable spacer 72 is inserted part way into this space by pushing the handle 76 on the insertable spacer 72 in towards the jack mount 16. A partial jacking stroke is now made during which the head pressure spacer 70 on the top surface of the first portion 36 contacts the bottom surface 96 of the insertable spacer 72. This prevents the first potion 36 from moving upwards while the second portion 38 and jack member 34 are forced downwards driving the wedge 24 a short distance into the log 20. This is repeated until the insertable spacer 72 is fully inserted and the handle 52 is once again at the bottom of the jacking stroke.

When the insertable spacer 72 is fully inserted and the handle is at the bottom of the jacking stroke the jack member 34 will have moved downwards ¾ of an inch and is engaged by the first portion 36. At this stage there is no load on the jack member 34 so the return spring 106 moves the insertable spacer 72 back into the first position 36 leaving about a ½ to ⅝ inch space between the top of the head pressure means 70 and the top plate 62 of the jack mount 16. The handle is moved upwards to the top of the return stroke which disengages the second portion 38 from the jack member 34 and allows it to move upwards adjacent to the first portion 36 which is engaged with the jack member 34.

The handle is now moved through a full jacking stroke as in regular operation. However since the first portion 36 of the jack body 30 is spaced about ½ of an inch from the top plate 62 of the jack mount 16 the first portion 36 of the jack body 30 moves upwards into contact with the top plate 62 without moving the second portion 38 or the jack member 34 as the handle 52 moves through the upper portion of the jacking stroke. As the handle 52 continues through the lower portion of the jacking stroke the jack 12 operates in the second ratio range with the fulcrum pin 48 being approximately ¼ inch from being in line with the jack member 34, and the second portion 38 and the jacking member 34 moving downwards driving the wedge 24 further into the log 20. This process may be repeated if it is still difficult to move the handle or the operator may return to regular use of the jack.

While one embodiment of the present invention has been described in the foregoing, it is to be understood that other embodiments are possible within the scope of the invention. The invention is to be considered limited solely by the scope of the appended claims.

I claim:

1. A hand jack and log splitting attachment comprising:

a hand jack having a jack body, a jack actuating means, and a jack member extending through the jack body, arranged such that manually actuating the jack actuating means causes the jack member to move downwards relative to the jack body;

and a log splitting attachment separate from the hand jack for receiving the hand jack mounted thereon including:

jack mounting means shaped and arranged to receive the jack body removably mounted thereon;

a frame including a frame base for supporting the frame on a supporting surface, and an upright support fixed at a lower end to the frame base and extending upwards therefrom and fixed at an upper end to the jack mounting means;

a log support for holding a log to be split, said log support being mounted on said frame at a position spaced downwards from the jack mounting means and aligned with the jack member;

and a wedge connected to a lower end of the jack member opposite the jack body for engaging a top of the log, such that manually actuating the jack actuating means causes the wedge to move downwards away from the jack body engaging the top of the log thereby splitting said log.

2. A hand jack and log splitting attachment in accordance with claim 1 wherein the jack mounting means comprises an elongate base member fixed to the upright support and lying in a substantially horizontal plane, a pair of parallel side plates each being fixed along a bottom edge to a respective side of the elongate base member and extending upwards therefrom, a top plate fixed along each of its sides to respective top edges of the pair of parallel side plates, a pair of vertically aligned openings one being arranged in each of the elongate base member and the top plate for receiving the jack member therethrough, and wherein the jack body can be removably received within the jack mounting means positioned on the elongate base member between the side plates and beneath the top plate.

3. A hand jack and log splitting attachment in accordance with claim 1 wherein the hand jack includes a plurality of output force to input force ratios.

4. A hand jack and log splitting attachment in accordance with claim 3 wherein the plurality of output force to input force ratios includes a first ratio range and a second ratio range and wherein the second ratio range has an output force to input force ratio of greater than the first ratio range.

5. A hand jack and log splitting attachment in accordance with claim 4 wherein the jack body includes a first portion and a second portion each arranged around the jack member adjacent to one another for alternately engaging the jack member and causing movement thereof as the actuating means is moved through a jacking stroke and a return stroke; and wherein as the actuating means is moved through the return stroke the first portion of the jack body engages the jack member holding it stationary and the second portion of the jack body moves along the jack member towards the first portion, and wherein as the actuating means reaches the top of the return stroke the second portion engages the jack member and the first portion disengages the jack member and moves downwards a distance from an upper surface of the jack mounting means, and wherein as the actuating means is moved through the jacking stroke the first portion is forced along the jack member away from the second portion until it contacts the upper surface of the jack mounting means causing the second portion and jack member to move in a direction opposite thereby driving the wedge downwards into the log; and wherein the output force to input force ratio changes from the first ratio range in a first part of the jacking stroke to the second ratio range in a second part of the jacking stroke as the actuating means is moved through a complete jacking stroke.

6. A hand jack and log splitting attachment in accordance with claim 5 wherein the hand jack includes a spacer means being insertable into the jack mounting means in steps for repositioning the hand jack within the jack mounting means such that the hand jack operates in the second ratio range.

7. A hand jack and log splitting attachment in accordance with claim 6 wherein the spacer means repositions the hand jack downwards from the upper surface of the jack mounting means such that when the spacer means is fully inserted the second portion of the jack body contacts the elongate member of the jack mounting means stopping its downwards movement when the actuating means is at the end of a jacking stroke.

8. A hand jack and log splitting attachment in accordance with claim 7 wherein the spacer means includes a head pressure spacer arranged on a top surface of the first portion of the jack body between the jack body and the upper surface of the jack mounting means, and an insertable spacer being slidably connected by slider means to an underside of the top plate of the jack mounting means having a lower surface for cooperation with an upper surface of the head pressure spacer, said insertable spacer being slidably movable from a first position through a plurality of incremental positions to a second position such that the insertable spacer when in a first position lies outside the jack mounting means and does not engage the head pressure spacer, and such that the insertable wedge when in the second position lies fully inserted within the jack mounting means with the lower surface thereof in contact with the top surface of the head pressure spacer thereby spacing the hand jack body from the top plate of the jack mounting means.

9. A hand jack and log splitting attachment in accordance with claim 8 wherein the insertable spacer comprises an elongate substantially U-shaped plate member for engaging around the jack member having a handle at a base of the U-shaped plate lying opposite the jack mounting means, a wedge portion extending downwards along a bottom of each arm of the U-shaped plate tapering from a maximum width adjacent the base of the U-shape plate to a minimum width at the end of each arm lying adjacent the jack mounting means, and a flange extending laterally outwards from the outer side edge of each arm; and wherein the head pressure spacer comprises a substantially U-shaped plate member engaging around the jack member adjacent the jack body having a wedge portion extending upwards along a top side of each arm of the U-shaped plate and tapering from a maximum width adjacent the base of the U-shape plate lying opposite to the insertable spacer to a minimum width at the end of each arm lying adjacent to the insertable spacer.

10. A hand jack and log splitting attachment in accordance with claim 9 wherein the slider means comprise a pair of rails each extending across a top edge of a respective one of the parallel side plates and outwards from a side of the jack mounting means, said pair of rails being spaced apart from one another and having a flange extending inwards for engaging respective flanges on the insertable spacer, and having a return spring arranged to return the insertable spacer to the first position when no load is applied to the hand jack.

11. A hand jack and log splitting attachment in accordance with claim 1 wherein the frame includes a first upright support fixed at a bottom end near one end of the frame base and extending upwards to a top end, a second upright support being removably and reengageably fixed at a bottom end to the frame base at an end opposite the first upright support and extending upwards to a top end, and wherein the jack mounting means includes an elongate base member which is fixed near each of its ends to a respective one of the first and second upright supports.

12. A hand jack and log splitting attachment in accordance with claim 11 wherein the first and second upright supports each include adjustment means for adjusting a height thereof.

13. A hand jack and log splitting attachment in accordance with claim 11 wherein the second upright support includes a lateral adjustment means comprising a plurality of spaced apart holes extending longitudinally along the frame base from the end of the frame base adjacent the second upright support inwards towards the first upright support, a flat plate being welded to the bottom end of the second upright support and having a threaded hole therethrough for alignment with one of the plurality of holes, and a bolt for engaging through said aligned holes, and a slidable connection means at a top end of the second upright support for engaging the jack mounting means.

14. A hand jack and log splitting attachment in accordance with claim 1 wherein the frame includes wedge lifting means for raising the jack member and wedge to a height such that a log may be positioned beneath the wedge for splitting.

15. A hand jack and log splitting attachment in accordance with claim 14 wherein the wedge lifting means comprises a lever having a guide means fixed at one end, and a pivot connection connecting the lever to the frame at a point spaced from one end of the lever, and an elongate flexible connection means fixed to a top surface of the wedge at one end and to the frame at an end opposite extending over the guide means between said ends, and wherein pivoting the lever in a first direction moves the guide means upwards drawing the elongate flexible connection means and the wedge upwards, and wherein pivoting the lever in a second direction moves the guide means downwards lowering the elongate flexible connection means and the wedge downwards.

16. A hand jack and log splitting attachment in accordance with claim 1 wherein the log supporting means comprises a plate fixed to a top surface of frame base and lying in a substantially horizontal plane.

17. A hand jack and log splitting attachment in accordance with claim 1 wherein the frame includes wheel means rotatably mounted to the frame base arranged to engage the supporting surface when the frame is tilted over the wheel means for transportation.

* * * * *